US008707637B1

(12) United States Patent
Nerad

(10) Patent No.: US 8,707,637 B1
(45) Date of Patent: Apr. 29, 2014

(54) SYSTEMS AND METHODS FOR REMOVABLE STAIR TREADS AND RISERS

(71) Applicant: Anthony Charles Nerad, Trinity, FL (US)

(72) Inventor: Anthony Charles Nerad, Trinity, FL (US)

( * ) Notice: Subject to any disclaimer, the term of this patent is extended or adjusted under 35 U.S.C. 154(b) by 0 days.

(21) Appl. No.: 13/753,246

(22) Filed: Jan. 29, 2013

(51) Int. Cl.
*E04F 11/00* (2006.01)
*E04F 19/00* (2006.01)

(52) U.S. Cl.
USPC ..... 52/183; 52/182; 52/188

(58) Field of Classification Search
USPC ..... 52/187, 188, 182, 183, 702, 712, 191, 52/184, 190
See application file for complete search history.

(56) References Cited

U.S. PATENT DOCUMENTS

| | | | | | |
|---|---|---|---|---|---|
| 4,709,520 | A * | 12/1987 | Vochatzer | 52/191 |
| 4,791,764 | A * | 12/1988 | Hicks | 52/187 |
| 4,819,391 | A * | 4/1989 | Tassin et al. | 52/182 |
| 4,866,894 | A * | 9/1989 | Brown | 52/182 |
| 5,293,722 | A * | 3/1994 | Reimann | 52/182 |
| 5,497,593 | A * | 3/1996 | Riesberg | 52/702 |
| 5,636,483 | A * | 6/1997 | Wille | 52/188 |
| 5,791,101 | A * | 8/1998 | Wallace | 52/191 |
| 6,088,977 | A * | 7/2000 | Lawrence | 52/182 |
| 6,758,016 | B2 * | 7/2004 | Gobeil | 52/191 |
| 8,245,453 | B2 * | 8/2012 | Struthers et al. | 52/27 |
| 2005/0160688 | A1 * | 7/2005 | Truckner et al. | 52/182 |
| 2007/0017169 | A1 * | 1/2007 | Gibson | 52/182 |
| 2008/0229686 | A1 * | 9/2008 | Raymond | 52/191 |
| 2009/0205267 | A1 * | 8/2009 | Prins | 52/105 |
| 2011/0167740 | A1 * | 7/2011 | Truckner | 52/191 |

* cited by examiner

*Primary Examiner* — Chi Q Nguyen
(74) *Attorney, Agent, or Firm* — Inventions International Inc.; Tiffany C. Miller

(57) ABSTRACT

Provided is a system and method for removable stair treads and risers having a bracket with a horizontal mounting surface and a vertical mounting surface. The bracket has openings on the horizontal mounting surface to allow a fastener to secure the bottom of a stair tread to the bracket. The bracket has openings on the vertical mounting surface to allow a fastener to secure the bracket to a supporting structure. The vertical mounting surface has at least one recess connected to a primary portion of an attaching element. A riser has a secondary portion of an attaching element attached to an unexposed surface of the riser located opposite at least one recess of the bracket. This allows the riser to be removably attached to the bracket without causing damage to the surrounding stair treads or risers.

1 Claim, 6 Drawing Sheets

SYSTEMS AND METHODS FOR REMOVABLE STAIR TREADS AND RISERS

BACKGROUND OF THE INVENTION

1. Field of the Invention

This invention relates, generally, to staircase tread and riser installation.

2. Background Art

The installation of pre-finished or unfinished, solid wood stair treads and risers into a staircase frame is time consuming. Installing pre-finished stair treads and risers into a staircase frame requires nails to penetrate their surfaces. When the stair tread or riser is nailed or fastened into the staircase frame, nail holes remain in the exposed surfaces. The installer has to perform an additional procedure to fill in the nail holes with a filler which makes the installation more costly and is unsightly. When stair treads and risers need to be refinished or replaced, the installer has to disassemble the staircase, which adds additional costs to refurbish a staircase. Alternatively, unfinished wood stair treads and risers are stained and then cleared with urethane or a similar material while installed in a staircase frame, which is a burden to a user as they cannot use the stairs until the curing process is complete. Moreover, the fumes associated with the chemical emissions of stains and urethanes pose as a health hazard to occupants.

Risers used in staircase systems deteriorate when users kick and ding them while ascending and descending the stairs. Risers often need to be replaced. Although prior art staircase risers can be replaced, without a way of easily removing a riser from the staircase, the replacement process can be time consuming, costly, and can damage the surrounding stair treads and risers.

There are several challenges to overcome with installing solid wood stair treads and risers in a staircase system. One challenge being the need for the stair tread and riser to be in contact with the frame of a staircase capable of sufficiently supporting the weight of a user. Currently, nails are driven through the exposed surface of the wood stair tread and riser to be secured to a staircase frame. The problem with a nail being driven through the exposed surface of the stair tread and riser into a staircase frame is the nail holes. Thus, there is a need for an improved method of installing stair treads and risers into a staircase frame that does not result in exposed nail holes.

Currently, many prior art methods of staircase riser installation result in the permanent placement of a riser. Permanently installed risers will need to be removed when they become damaged or worn. The replacement of a permanent riser can result in damage to the surrounding staircase. Thus, there is a need for an improved method of installing a stair riser, allowing the riser to be removable to prevent damage to the surrounding staircase.

Prior art methods of stair tread installation do not allow for a stair tread to be removed for replacement. Stair treads become damaged from users scuffing and wearing them from walking up and down the stairs. Additionally, damage occurs when objects are dropped onto the stair tread resulting in a dent. Thus, there is a need for a stair tread system that allows for easy removal of a stair tread. It is more desirable for a user to have the ability to remove the stair treads without the costly labor associated with prior art stair treads. More particularly, a stair tread system that allows for stair tread removal prevents damage to the surrounding staircase when being removed.

However, in view of the prior art considered as a whole at the time the present invention was made; it was not obvious to those of ordinary skill in the pertinent art how the identified needs could be fulfilled.

SUMMARY OF THE INVENTION

The long-standing but heretofore unfulfilled need for a staircase system having a removable stair tread and which also includes improvements that overcome the limitations of prior art staircase systems, is now met by a new, useful, and non-obvious invention.

The novel staircase system has a stair tread, a riser, and a supporting structure. A bracket is connected to a stair tread. The bracket receives a stair tread on the horizontal mounting surface. A preferred method of connecting a stair tread to the novel bracket is by screwing a nail to the stair tread from an unexposed surface of the stair tread, preferably from the bottom of the stair tread. This will secure the stair tread to the bracket without visible nail holes to the exposed stair tread surface. The bracket also has a vertical mounting surface which receives a riser. It is also envisioned to secure an end of the stair tread to the bracket by screwing through the vertical mounting surface to an end of the stair tread that is abutting the vertical surface of the bracket. The bracket is constructed of including, but not limited to, a magnetically attractive material or plastic. The vertical mounting surface has at least one recess. In a preferred embodiment, at least one recess is in magnetic communication with a magnet. The magnet is connected to an unexposed surface of the riser located opposite the recess. The recess is magnetically attracted to the magnet. This magnetic communication secures the riser to the bracket. It is also envisioned that at least one recess is not in magnetic communication with a magnet. At least one recess has a first portion of an attaching element including, but not limited to, a magnet, a snap, a button, a latch, or a hook and loop attachment. The attaching element is in communication with a second portion of the attaching element located on an unexposed surface of the riser located opposite the at least one recess.

In an alternate embodiment, a first bracket with at least one recess is positioned on one end of the supporting structure. A second bracket with at least one recess is positioned on the opposite end of the supporting structure. A plurality of brackets may be needed to support a variety of lengths of stair treads and risers. Additionally, the bracket may have a plurality of recesses and a plurality of the first portion of an attaching element attached to the plurality of recesses, and a plurality of the second portion of an attaching element located on the unexposed surface of the riser located opposite the plurality of recesses. The horizontal mounting surface of the bracket has openings to allow screws to secure the bottom surface of a stair tread to the bracket. Additionally, the vertical mounting surface may have openings to allow screws to secure an end of the stair tread to the bracket. The vertical mounting surface has openings to fasten the bracket to the staircase supporting structure. The staircase supporting structure includes, but is not limited to a wood frame, composite, concrete, or metal. These materials are illustrative of the invention and are not exhaustive thereof. All materials are within the scope of this invention.

The novel bracket system with a horizontal mounting surface and a vertical mounting surface for the stair tread to be fastened to results in a removably mounted stair tread. By constructing the novel bracket with at least one recess located on the vertical mounting surface, connected to a primary portion of an attaching element having communication with a secondary portion of an attaching element connected to an unexposed surface of a riser, makes such a bracket structure produce a removable riser. This is due to the ability of the primary portion of the attaching element to bias or connect to the secondary portion of the attaching element.

The improved stair tread and riser system connects a bracket to a supporting structure and results in a removable stair tread and riser system without damaging the surrounding staircase components. By having a removable way of refinishing or replacing stair treads and risers, the stair treads and risers can be repaired or installed in a cost efficient manner, and the staircase may be used promptly after installation.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
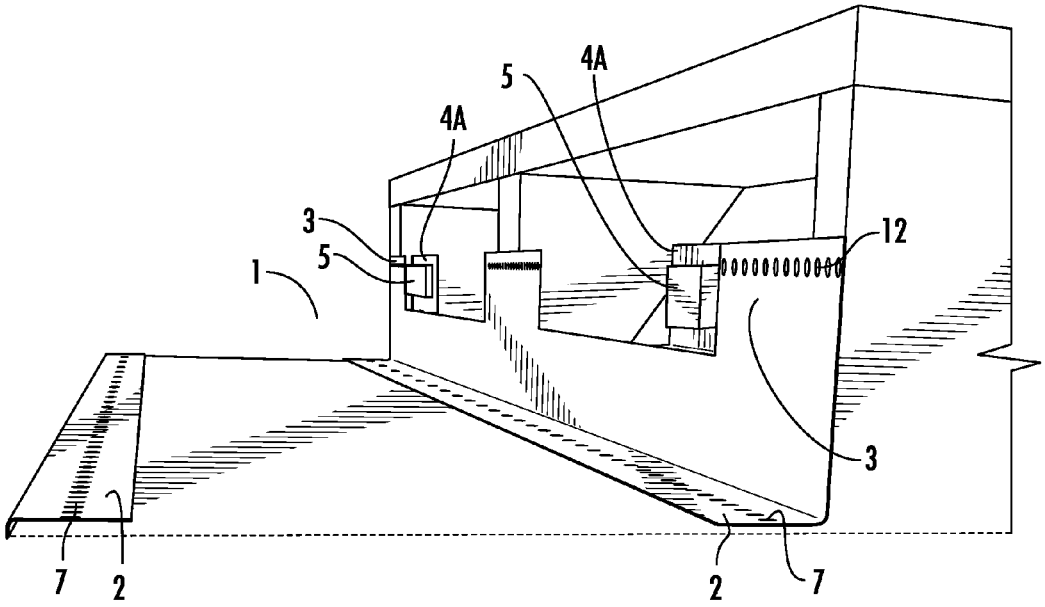
FIG. 1 is a perspective view of the novel stair tread and riser system.

In the following detailed description of the preferred embodiments, reference is made to the accompanying drawings, which form a part hereof, and within which are shown by way of illustrating specific embodiments by which the invention may be practiced. It is to be understood that other embodiments may be utilized and structural changes may be made without departing from the scope of the invention.

In a preferred embodiment, FIGS. 1-4 show the novel stair tread and riser system having bracket 1 with horizontal mounting surface 2 located perpendicular to vertical mounting surface 3. Horizontal mounting surface 2 has opening 7 to allow a fastener including, but not limited to, a screw or a nail to secure the bottom portion 11 of stair tread 10 to bracket 1. It is also within the scope of this invention for a plurality of openings 7 located on horizontal mounting surface 2 to allow a plurality of fasteners to secure the bottom portion 11 of stair tread 10 to bracket 1. It is also within the scope of this invention to attach the stair tread 10 to an opening 14 on vertical mounting surface 3 of bracket 1.

Figure 4:
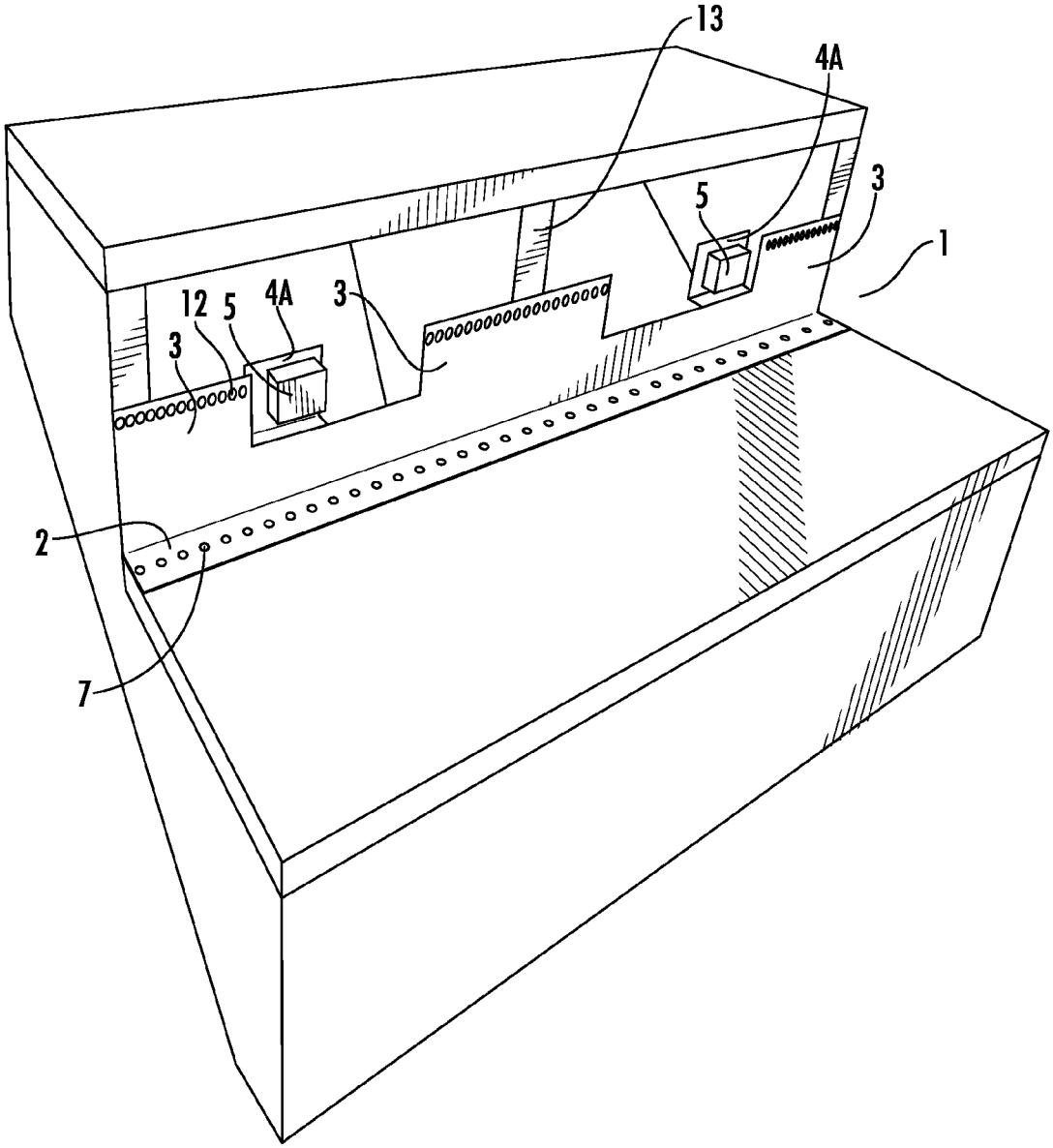
FIG. 4 is a perspective view of the stair tread and riser system.

Vertical mounting surface 3 has opening 14 to allow a fastener to secure an end of the stair tread to bracket 1 (not shown). A plurality of openings 14 located on vertical mounting surface 3 allows a plurality of fasteners to secure the stair tread to bracket 1 (not shown). As best shown in FIG. 4, vertical mounting surface 3 has a plurality of openings 12 to allow a fastener to connect bracket 1 to supporting structure 13.

Figure 2:
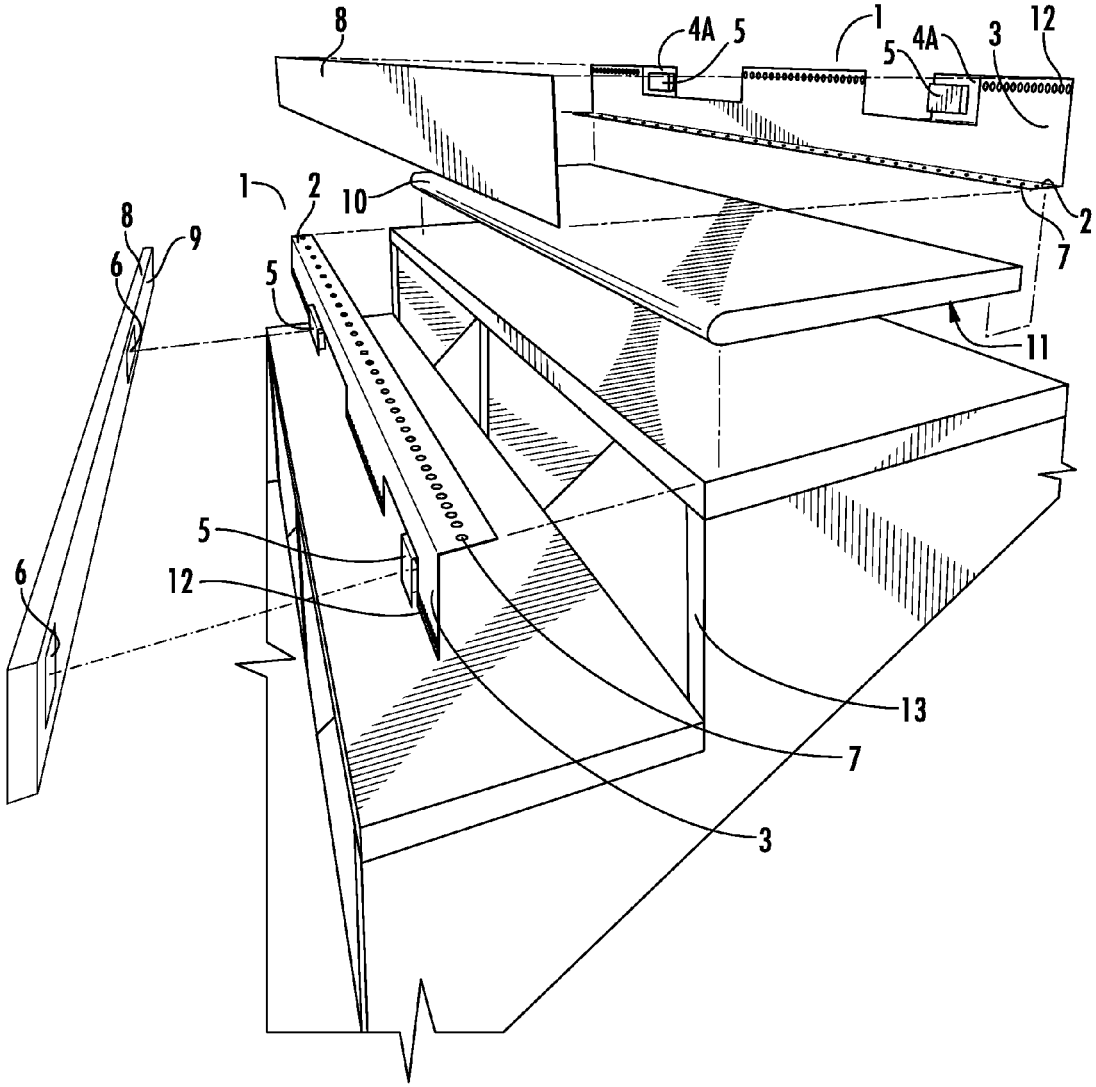
FIG. 2 is an exploded perspective view of the novel stair tread and riser system.

As shown in FIGS. 1 and 2, at least one recess 4A is located on vertical mounting surface 3 and is connected to primary portion of attaching element 5 including, but not limited to, a magnet, a snap, a button, a latch, a magnetically attractive material, or a hook and loop attachment. FIG. 2 depicts primary portion of attaching element 5 in communication with secondary portion of attaching element 6 connected to an unexposed surface 9 of riser 8 located opposite at least one recess 4A. It is also within the scope of this invention for bracket 1 having a plurality of recesses 4A connected to a plurality of primary portions of attaching elements 5 in communication with a plurality of secondary portions of attaching elements 6 connected to an unexposed surface 9 of riser 8 located opposite bracket 1.

Figure 5:
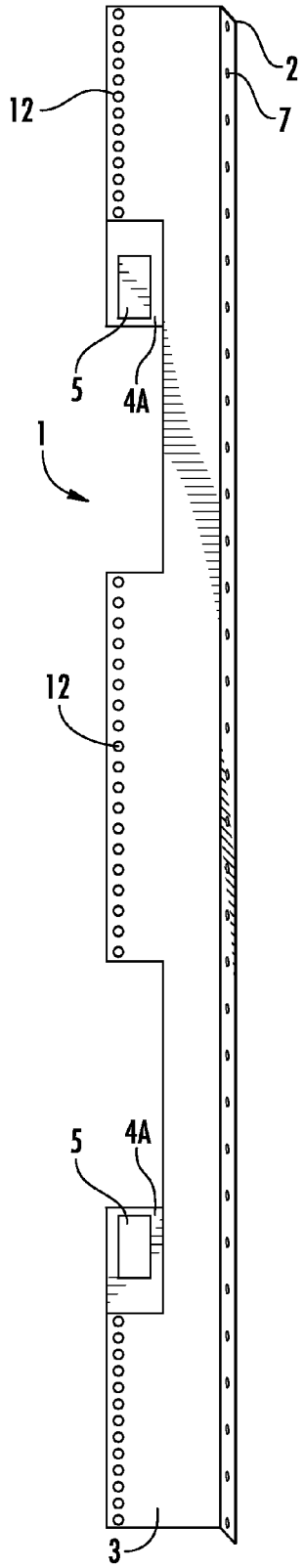
FIG. 5 is a front perspective view of bracket 1.
Figure 6:
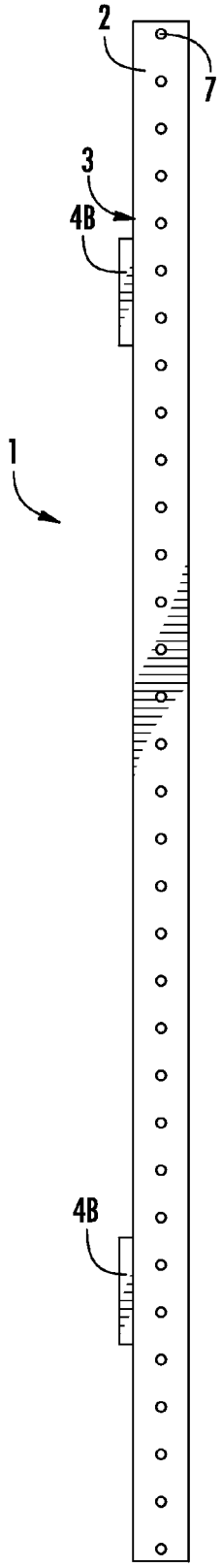
FIG. 6 is a rear perspective view of bracket 1.

FIG. 5 shows novel bracket 1 having horizontal mounting surface 2 located perpendicular to vertical mounting surface 3. Vertical mounting surface 3 has openings 12 to fasten bracket 1 to supporting structure 13. Recess 4A is located on vertical mounting surface 3 and is connected to primary portion of attaching element 5. FIG. 6 illustrates horizontal mounting surface 2 having opening 7 to accommodate a fastener. The opposite side of recess 4A is side 4B, located on vertical mounting surface 3.

The described embodiments are illustrative of the invention and are not exhaustive thereof. As the staircase industry adds additional or different restrictions on installation requirements for building codes, still further bracket structures may be required in future embodiments of the invention but all such future embodiments are within the scope of this invention.

For example, stair tread manufacturers make stair treads in the following sizes: 35¾", 41¾", 47¾", 53¾", 59¾", 65¾", and 71¾". Depending on the varying stair tread lengths, it is a preferred embodiment to have vertical mounting surface 3 with at least three sections of a plurality of openings 12. A user can fasten the vertical mounting surface 3 of bracket 1 to the supporting structure 13 through opening 12. More particularly, fasteners can be screwed through opening 12 of the three sections of vertical mounting surface 3 into the three portions of the supporting structure 13 including, but not limited to, a staircase frame or concrete stairs. Larger stair treads require at least four sections of a plurality of openings 12 to accommodate the building codes and because the supporting structure 13 will have four portions to have bracket 1 connect to. It is also within the scope of this invention that bracket 1 has vertical mounting surface 3 with a plurality of openings 12 throughout its entirety, with no separate sections (not shown).

Thus, vertical mounting surface 3 will connect with all sized supporting structures 13 and in view of this disclosure any future changes in bracket 1 structures can be met.

Moreover, as mentioned, each embodiment of the illustrative embodiments will accommodate stair tread 10, regardless of the size of stair tread 10 and configuration of openings 7 therein. A stair tread 10 is provided to be in connection with novel bracket 1. The stair tread 10 is attached to novel bracket 1 by fasteners screwed through opening 7 of horizontal mounting surface 2. It also within the scope of this invention for stair tread 10 to be attached to bracket 1 by fasteners screwed through opening 14 of vertical mounting surface 3. The vertical mounting surface 3 of bracket 1 is attached to the supporting structure 13 by fasteners inserted through opening 12. Bracket 1 has vertical mounting surface 3 having at least one recess 4A. A riser 8 is provided having at least one attaching element 6 attached to the unexposed surface 9 of riser 8, located opposite at least one recess 4A of bracket 1. A user then configures the attaching element to hold the riser 8 in position. At least one recess 4A of bracket 1 comprises a magnetically attractive material. At least one recess 4A of bracket 1 is connected to at least one secondary portion of attaching element 5. The opposite side of recess 4A is side 4B. Recess 4A is connected to attaching element 5. Side 4B does not come in contact with an attaching element.

Although, magnets can be attached to riser 8 and placed parallel to recess 4A on bracket 1, any attaching element in communication with riser 8 and recess 4A of bracket 1 can secure riser 8 in a removable manner without the need for demolition. It is within the scope of this invention for riser 8 to be manufactured of including, but not limited to, a magnetically attractive material such as a stamped metal riser. The magnetically attractive riser is positioned opposite recess 4A and configured to communicate with primary portion of attaching element 5 to secure riser 8 to bracket 1.

In addition to the aforesaid embodiments of novel bracket 1 of stair tread and riser system, bracket 1 includes multiple additional improvements as well.

An improvement as shown in FIG. 2 includes secondary portion of attaching element 6 connected to an unexposed surface 9 of the riser 8. Secondary portion of attaching element 6 is located opposite of primary portion of attaching element 5 and is in communication with primary portion of attaching element 5. Primary portion of attaching element 5 is connected to recess 4A of bracket 1. This allows riser 8 to be removably attached to bracket 1 without causing damage to the surrounding stair treads or risers.

Bracket 1 is further improved by having recess 4A located on vertical mounting surface 3. Recess 4A has a depression.

These and other important objects, advantages, and features of the invention will become clear as this description proceeds.

The invention accordingly comprises the features of construction, combination of elements, and arrangement of parts that will be exemplified in the description set fourth hereinafter and the scope of the invention will be indicated in the claims.

Construction of the Novel Removable Stair Tread and Riser System

Figure 3:
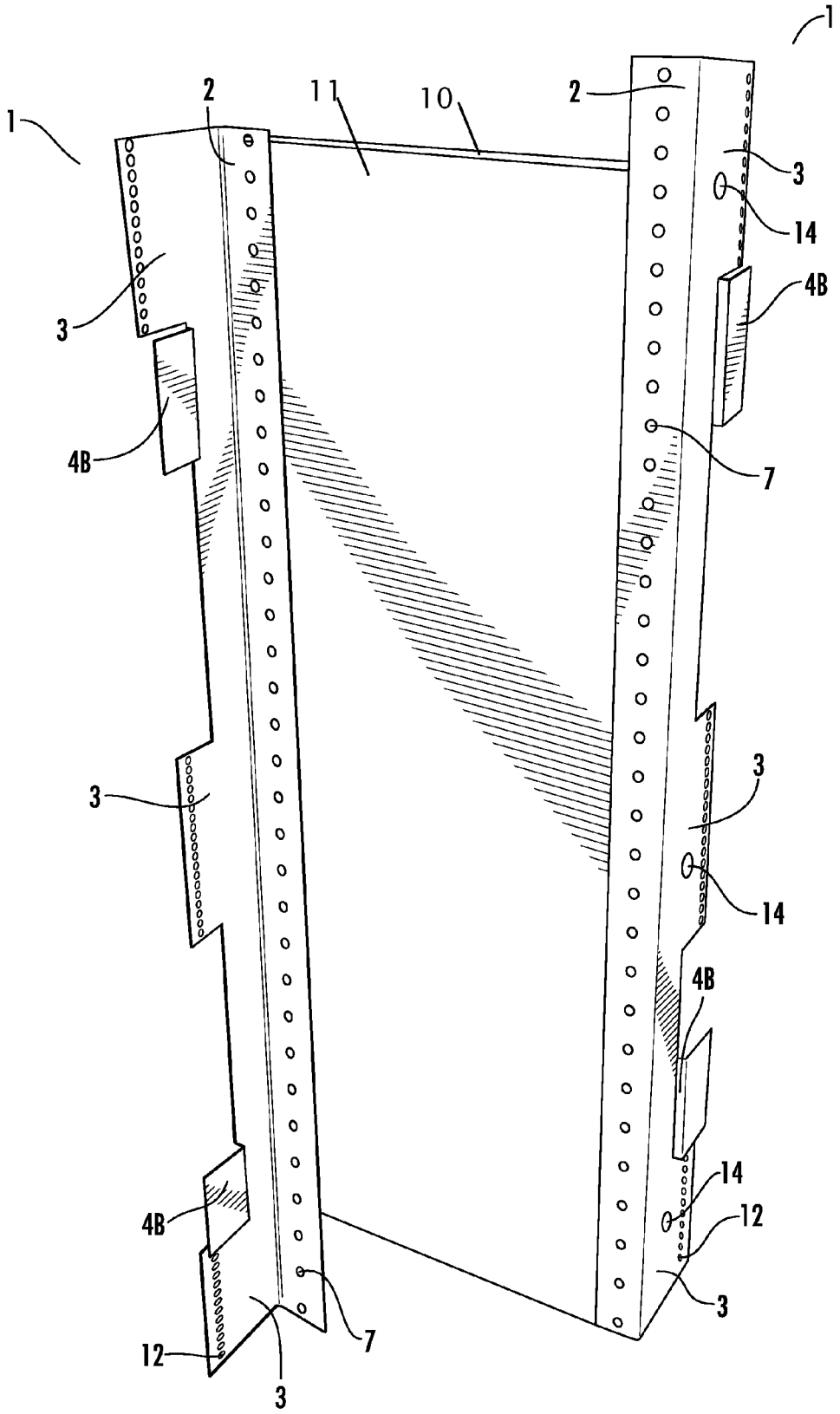
FIG. 3 is a rear perspective view of the stair tread and riser system.

Referring now to FIGS. 1-5, it will be seen that the reference numeral 1 denotes an illustrative embodiment of novel bracket 1 as a whole. FIG. 2 illustrates novel removable stair tread and riser system assembled by having a stair tread 10, a riser 8, and a supporting structure 13. As best shown in FIG. 3, bracket 1 has a horizontal mounting surface 2 having opening 7 which receive fasteners to attach bracket 1 to a bottom portion 11 of stair tread 10. Vertical mounting surface 3 has opening 12 to receive fasteners to secure bracket 1 to supporting structure 13. Recess 4A is located on vertical mounting surface 3. Primary portion of attaching element 5 is connected to recess 4A. The opposite side of recess 4A is side 4B. As illustrated in FIG. 2, secondary portion of attaching element 6 is connected to unexposed surface 9 of riser 8 located opposite primary portion of attaching element 5.

In FIG. 3, a fastener may secure an end of stair tread 10 through an opening 14 on vertical mounting surface 3 of bracket 1. In FIG. 6, horizontal mounting surface 2 has openings 7. Vertical mounting surface 3 has recess 4A and opposite side of recess 4B located thereon.

Terms

As used herein, the term "attaching element", refers to a structure that has the ability to secure a riser to a bracket. Examples include, but are not limited to: a magnet, a snap, a button, a latch, a magnetically attractive material, or a hook and hoop attachment.

As used herein, the term "supporting structure", refers to any staircase frame including, but not limited to: wood, steel, or concrete.

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

Now that the invention has been described,

The invention claimed is:

1. A staircase comprising a stair tread, a riser, and a supporting structure, comprising:

a bracket connected to a stair tread, said bracket constructed of a magnetically attractive material;

said bracket having a vertical mounting surface;

said vertical mounting surface having at least one recess, whereby, said at least one recess is constructed of said magnetically attractive material; and, at least one magnet connected to a surface of said riser, said riser located opposite said at least one recess, whereby, said at least one magnet is horizontally engaged into said at least one recess, whereby, said at least one magnet is in magnetic communication with said at least one recess.

* * * * *